US005160130A

United States Patent [19]

Fromm et al.

[11] Patent Number: 5,160,130

[45] Date of Patent: Nov. 3, 1992

[54] THIN-TIP STRIPPER FINGER FOR USE WITH A FUSER ROLL IN AN ELECTROPHOTOGRAPHIC APPARATUS

[75] Inventors: Paul M. Fromm, Rochester; Timothy R. Jaskowiak, Webster, both of N.Y.

[73] Assignee: Xerox Corporation, Stamford, Conn.

[21] Appl. No.: 797,668

[22] Filed: Nov. 25, 1991

[51] Int. Cl.[5] ..... B65H 29/54

[52] U.S. Cl. ..... 271/307; 271/900

[58] Field of Search ..... 271/307, 311, 900

[56] References Cited

U.S. PATENT DOCUMENTS

| | | | |
|---|---|---|---|
| 4,156,524 | 5/1979 | Bar-on | 271/311 |
| 4,315,622 | 2/1982 | Idstein | 271/311 |
| 4,447,054 | 5/1984 | Sone | 271/311 |
| 4,487,158 | 12/1984 | Kayson | 271/311 X |
| 4,687,696 | 8/1987 | Staoji | 428/192 |
| 4,755,848 | 7/1988 | Tamary | 271/311 X |
| 4,771,310 | 9/1988 | Leo | 271/311 X |
| 4,796,880 | 1/1989 | Tamary | 271/311 |
| 4,806,985 | 2/1989 | Foley | 271/311 X |
| 4,929,983 | 5/1990 | Barton et al. | 355/315 |
| 4,951,936 | 8/1990 | Taniyama | 271/311 X |

*Primary Examiner*—Richard A. Schacher
*Attorney, Agent, or Firm*—R. Hutter

[57] ABSTRACT

A stripper finger separates a substrate from a fuser member in an electrophotographic printing apparatus. The stripper finger is a member defining an edge in the form of a symmetrical convex arc across the width of the member. The thickness of the member decreases from a chord through the convex arc perpendicular to the axis of symmetry of the arc, to the edge.

15 Claims, 5 Drawing Sheets

THIN-TIP STRIPPER FINGER FOR USE WITH A FUSER ROLL IN AN ELECTROPHOTOGRAPHIC APPARATUS

FIELD OF THE INVENTION

The present invention relates to a stripper finger for electrophotographic printers, and, more specifically, a stripper finger for stripping a print substrate from a fuser member.

BACKGROUND OF THE INVENTION

In electrophotographic printers commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the original document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the photoconductive insulating area to form a powder image on the photoconductive area. This image is subsequently transferred to a support surface, such as copy paper, to which it is permanently affixed by heating or by the application of pressure. Following transfer of the toner image to a support surface, the photoconductive insulating member is cleaned of any residual toner that may remain thereon in preparation for the next imaging cycle.

One of the more conventional approaches to fixing the toner image is through the use of heat and pressure by passing the print substrate containing the unfused toner images between a pair of opposed roller members at least one of which is internally heated. During this procedure, the temperature of the toner material is elevated to a temperature at which the toner material coalesces and becomes tacky. This heating causes the toner to flow to some extent into the fibers or pores of the support member. Thereafter, as the toner material cools, solidification of the toner material causes the toner material to become bonded to the support member. Typical of such fusing devices are two roll systems wherein the fuser roll is coated with an adhesive material such as a silicone rubber or other low surface energy elastomers. The silicone rubbers that can be used as the surface of the fuser member include room temperature vulcanizable silicones, referred to as RTV silicones, liquid injection moldable or extrudable silicone rubbers, and high temperature vulcanizable silicones referred to as HTV silicones. Other known suitable materials for the surface of the fuser roll include those sold under the trade names VITON and TEFLON, the latter being a polymer as opposed to an elastomer.

During the fusing process and despite the use of low surface energy materials as the fuser roll surface, there is a tendency for the copy print substrate to remain tacked to the fuser roll after passing through the nip between the fuser roll and the pressure roll. When this happens, the tacked print substrate does not follow the normal substrate path but rather continues in an arcuate path around the fuser roll, eventually resulting in a paper jam which will require operator involvement to remove the jammed paper before any subsequent imaging cycle can proceed. As a result it has been common practice to use one or more techniques to ensure that the print substrate is stripped from the fuser roll downstream of the fuser nip. One of the common approaches has been the use of a stripper finger or a plurality of stripper fingers placed in contact with the fuser roll to strip the print substrate from the fuser roll. While satisfactory in many respects, this suffers from difficulties with respect to both fuser roll life and print quality. To ensure an acceptable level of stripping it is frequently necessary to load such a stripper finger against the fuser roll with such a force and at such an attack angle that there is a tendency to peel the silicone rubber off the fuser roll, thereby damaging the roll to such an extent that it can no longer function as a fuser roll. In addition, since the finger comes in contact with the surface of the print substrate which has hot, just fused toner image thereon, there is a tendency for the stripper finger to scrape toner from the print substrate thereby creating a copy quality defect in the form of a line which may be the width of the stripper finger. Furthermore, while a stripper finger may only slightly deform the toner this may create a defect in the form of a stripe of higher gloss than the rest of the print. It has also been found that stripper fingers,typically made of high energy materials become contaminated with toner on the side in contact with the fuser roll, eventually resulting in the stripper finger lifting off the fuser roll and resulting in paper jams.

Another common problem associated with stripper fingers as they have been heretofore used is "lead edge nicks" in the support material, such as sheets of paper. Lead edge nicks occur when a substrate, such as a sheet of paper, strikes a stripper member which is too thick at the tip. Number 20 paper, for example, is 0.09 mm thick with a substantially square edge, while an uncoated stripper member is typically 0.1 mm thick and also square edged. If the edge of the stripper member is angled 15° toward a tangent of a 75 mm diameter fuser roll, a finger thickness up to 0.14 mm is acceptable to avoid failure of the stripper member to strip the copy off the fuser roll. However, lead edge nicks are persistent if the tip is larger than 0.025 mm thick if the tip or the paper corner is square-edged, or 0.075 mm thick if rounded. Coatings on the stripper member may add up to 0.075 mm to the finger thickness.

As a result of the difficulties associated with stripper fingers, use has been taken in many instances of air stripping systems. While satisfactory in many respects, the air stripping systems are typically very expensive, involving elaborate air delivery systems.

U.S. Pat. No. 4,687,696 to Satoji describes a finger strip for separating sheets of paper from a fuser roll in a copying machine which is made of a heat resistant resin and has at least a tip portion coated to a thickness of about 40 angstroms to 1 micron of fluorinated polyether polymer to improve lubricity and add anti-stickiness. High adhesion strength between the coating and the finger help to eliminate the problem of poor separation and jamming of paper.

U.S. Pat. No. 4,929,983 to Barton et al. describes a stripper for separating a print substrate from a fuser roll.

The stripper has a substantially flat, thin, resiliently flexible finger-like member with a raised dimple-like bump for contacting the print substrate when it is stripped from the fuser member. The finger-like member is coated on both sides with a smooth low surface energy film.

U.S. Pat. No. 4,796,880 to Tamary discloses a skive for removing a copy sheet from a hot fuser roller. The skive engages the fuser roller at a small acute angle so that a sheet will be deflected from the roller along the desired paper path. An anti-gouge stiffener is provided adjacent the finger, which is engageable by the finger to prevent it from flexing in the wrong direction.

It is an object of the present invention to provide a stripper finger for use with a fuser roll in an electrophotographic apparatus which avoids many of the problems of prior art devices, such as lead-edge nicks on sheets coming off the fuser roll, bending of the stripper finger, and damage to the fuser roll.

It is another object of the present invention to provide such a stripper finger which is simple to manufacture from inexpensive materials using commonly-available techniques.

Other objects will appear hereinafter.

SUMMARY OF THE INVENTION

In accordance with the above objects, the present invention is a stripper finger for separating a substrate from a fuser member in an electrophotographic printing apparatus. The stripper finger is a single member having a first surface and a second surface, defining a thickness therebetween. The first surface is adapted to be disposed adjacent and at an acute angle relative to a surface of the fuser member. The member further defines an edge, in the form of a symmetrical convex arc across the width of the first surface and the second surface. The thickness between the first surface and the second surface decreases from a chord through the convex arc perpendicular to the axis of symmetry of the arc, to the edge.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
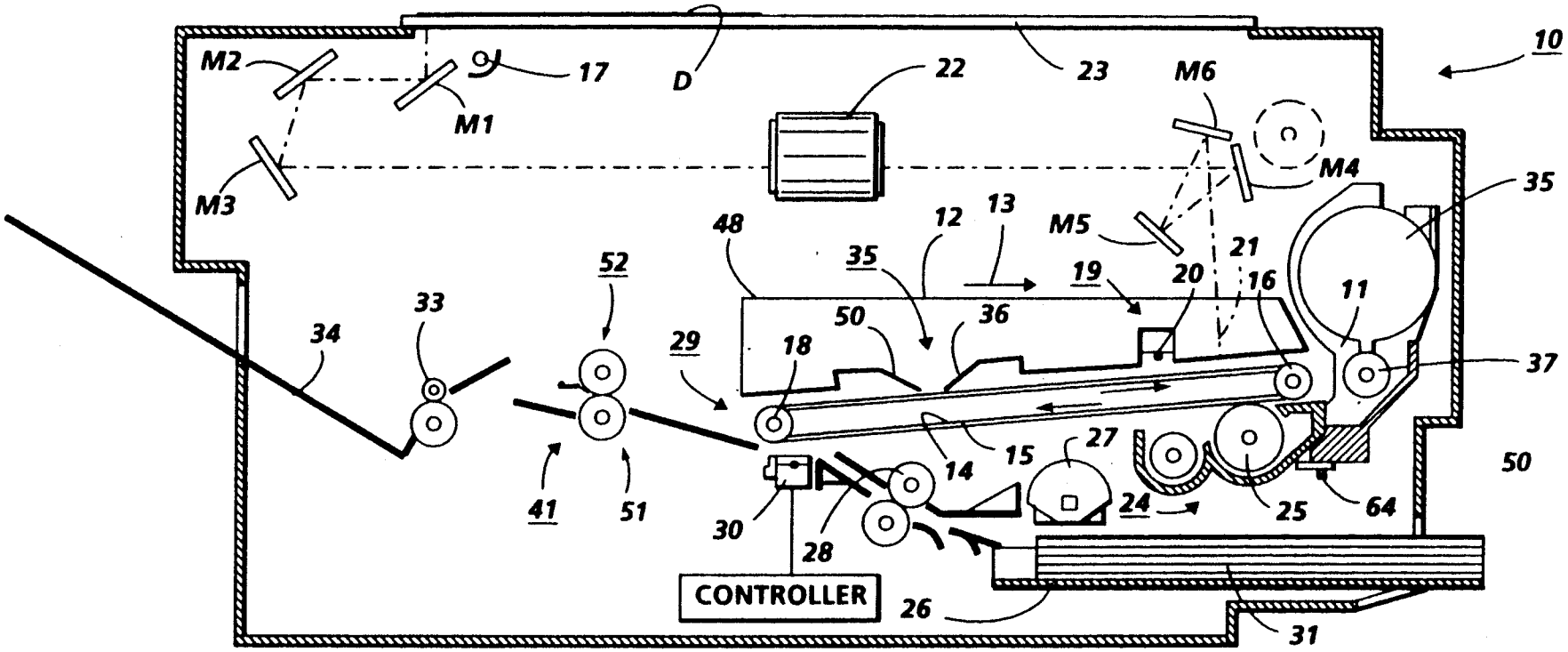
FIG. 1 is a schematic representation and cross section of an electrophotographic copying machine, as would use a stripper finger according to the present invention.

Referring now to FIG. 1, there is shown, by way of example, an automatic electrophotographic reproducing machine 10 which includes a removable processing cartridge 12. The reproducing machine depicted in FIG. 1 illustrates the various components utilized therein for producing copies from an original document. Although the invention is particularly well adapted for use in automatic electrophotographic reproducing machines, it should become evident from the following description that it is equally well suited for use in a wide variety of processing systems including other electrophotographic systems and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt-like member 14, the outer periphery of which is coated with a suitable photoconductive material 15. The belt is suitably mounted for revolution within the cartridge about driven transport roll 16 around idler roll 18, and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input information is recorded upon a sheet of final support material 31, such as paper or the like. Initially, the belt 14 moves the photoconductive surface 15 through a charging station 19 wherein the belt is uniformly charged with an electrostatic charge placed on the photoconductive surface by charge corotron 20, in known manner, preparatory to imaging. Thereafter, the belt 14 is driven to exposure station 21, where the charged photoconductive surface 15 is exposed to the light image of the original input information. Here the charge is selectively dissipated in the light exposed regions to record the original input image in the form of an electrostatic latent image.

The optical arrangement creating the latent image comprises a scanning optical system with lamp 17 and mirrors M1, M2, M3 mounted to a scanning carriage (not shown) to scan the original document D on the imaging platen 23, lens 22, and mirrors M4, M5, M6 to transmit the image to the photoconductive belt in known manner. The speed of the scanning carriage and the speed of the photoconductive belt are synchronized to provide faithful reproduction of the original document. After exposure of belt 14, the electrostatic latent image recorded on the photoconductive surface 15 is transported to development station 24, wherein developer is applied to the photoconductive surface 15 of the belt 14, rendering the latent image visible. The development station includes a magnetic brush development system, including developer roll 25 utilizing a magnetizable developer mix having coarse magnetic carrier granules and toner colorant particles supplied from developer supply 11 and auger transport 37.

Sheets 31 of the final support material are supported in a stack arranged on support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29. The toner image is transferred from the photoconductive surface 15 to the contacting side of the final support sheet 31 by means of transfer corotron 30. Following transfer of the image, the final support material, which may be paper, plastic, etc., as desired, is separated from the belt by the beam strength of the support material 31 as it passes around the idler roll 18, and the sheet containing the toner image thereon is advanced to fusing station 41.

Fusing station 41 comprises heated fuser roll 52 and pressure roll 51, forming a nip therebetween wherein fuser roll 52 fixes the transferred powder image thereto. After the toner image is fused to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scraping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush, as is well known in the art.

It is believed that the foregoing general description is sufficient for the purposes of the present invention to illustrate the general operation of an automatic xerographic copier 10 which can embody the apparatus in accordance with the present invention.

Figure 2:
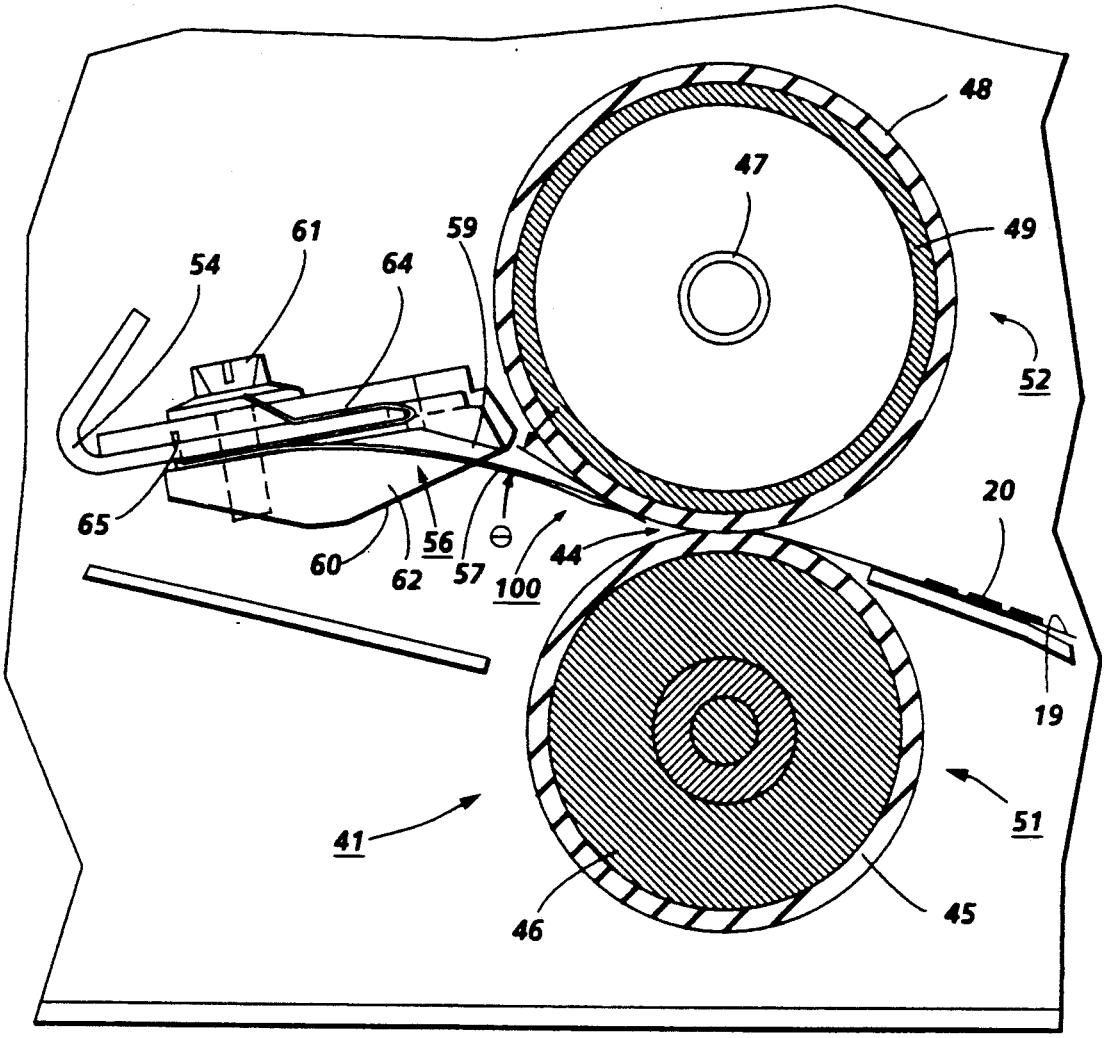
FIG. 2 is an enlarged cross sectional view of the stripper mechanism according to the present invention, associated with the fusing system.

Turning now to FIG. 2, the stripper mechanism according to the present invention will be described in greater detail. The fuser roll 52 comprises a core 49 having coated thereon a thin layer 48, typically of an elastomer. The core 49 may be made of various metals such as iron, aluminum, nickel, stainless steel, etc., and various synthetic resins. Aluminum is preferred as the material for the core 49, although this is not critical. The core 49 is hollow and a heating element 47 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser roll can be heated by internal means, external means or a combination of both. The thin fusing elastomer layer may be made of any of the well known materials such as the RTV and HTV silicone elastomers referred to above, or VITON, or TEFLON.

The fuser roll 52 is shown in a pressure contact arrangement with a pressure roll 51. The pressure roll 51 comprises a metal core 46 with a layer 45 of a heat-resistant material. In this assembly, both the fuser roll 52 and the pressure roll 51 are mounted on shafts (not shown) which are biased so that the fuser roll 52 and pressure roll 51 are pressed against each other under sufficient pressure to form a nip 44. It is in this nip that the fusing or fixing action takes place. It has been found that the quality of the copies produced by the fuser assembly is better when the nip is formed by a relatively hard and thick layer 45 with a relatively flexible thin layer 48. In this manner, the nip is formed by a slight deformation in the layer 48 and major deformation of layer 45 due to the loading of the fuser roll 52 to the pressure roll 51. The layer 45 may be made of any number of well known materials, such as fluorinated ethylenepropylene copolymer or silicone rubber.

FIG. 2 further shows in detail the structure supporting a stripper finger adjacent the fuser roll 52. There are typically a plurality of stripper fingers associated with one fuser roll, although only one is shown in this side view. Each stripper finger is preferably formed as part of a clip generally indicated as 56. Each stripper finger 100 is disposed so that its effective portion is at an acute angle, typically approximately 15°, relative to the tangent of the surface 48 of a fuser roll 52 at the point where the tip of the stripper member is closest to the surface 48. The tip of the stripper finger is preferably disposed approximately 3 mm downstream from the nip between fuser roll 52 and pressure roll 51. To insure proper stripping, the stripper fingers are placed in contact with the fuser roll which is balanced between a high load resulting in undue wear to the fuser roll, and a lower load resulting in an undue jam rate. Typically, the force applied is from about 10 grams to 20 grams and preferably between 13 and 17 grams.

Figure 3A:
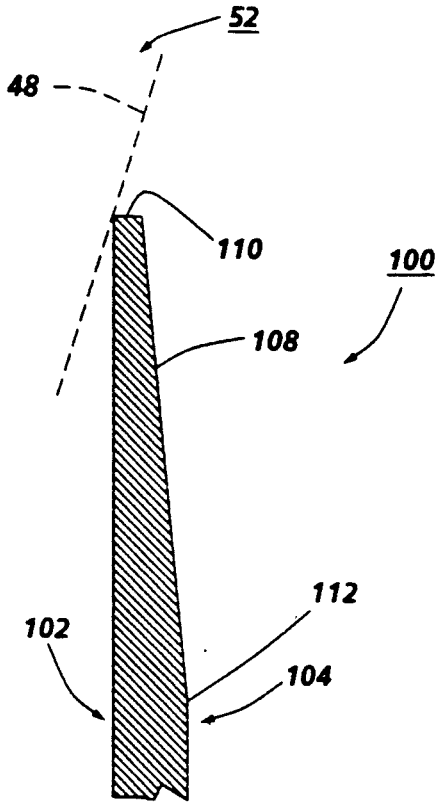
FIGS. 3A and 3B are alternate views showing the tip of the stripper finger of the present invention, in isolation.
Figure 3B:
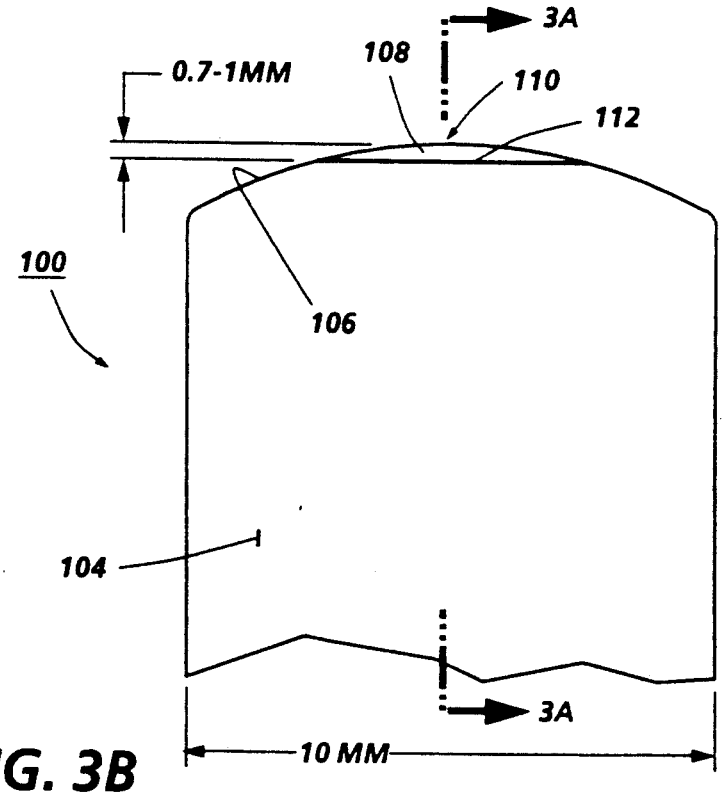

FIGS. 3A and 3B show the effective portion of a stripper member, or finger, 100, according to the present invention. The stripper finger 100 is a substantially flat resiliently flexible finger-like member that is capable of providing an essentially constant load on the fuser roll 52 with small positional variations. Stripper finger 100 is shown having two main surfaces, a fuser roll side 102 and an outer side 104. A preferred width of stripper member 100 across surfaces 102 and 104 is approximately 10 mm. Preferably, the thickness of the stripper member 100 between surfaces 102 and 104 is approximately 0.1 mm.

Viewing the stripper member 100 in FIG. 3B, as it sits against the surface 48 of fuser roll 52, it can be seen that the edge 106 of stripper member 100 forms a symmetrical convex arc. At the top of the arc formed by edge 106, in the area of stripper member 100 forming the tip 110, is a tapered portion 108. The tapered portion 108 is defined by an area from a chord 112 through a portion of the arc formed by edge 106, the chord being perpendicular with the axis of symmetry of the arc. As can be seen in FIG. 3A, the tapered portion 108 forms a linearly decreasing thickness between surfaces 102 and 104 from the chord 112 to the tip 110. In the preferred embodiment, the tapered portion 108 starts at the chord 112 with the thickness of the main part of the stripper member 100, and decreases toward the tip 110 to a thickness approximately one-half the thickness of stripper member 100 at the chord 112. In the preferred embodiment, wherein the thickness of the main portion of the stripper member 100 is approximately 0.1 mm, the thickness at the tip 110 is approximately 0.05 mm. The length of the tapered portion 108, from the chord 112 to the tip 110, is preferably 0.7 to 1.0 mm.

The stripper member 100 of the present invention has been found to eliminate the copy quality defect known as lead edge nicks, as described hereinabove. The stripper member succeeds in this mainly because the shape of the member allows the tip 110 to engage the edge of a sheet on the fuser roll in an area of less than half the thickness of the sheet, on the side of the sheet contacting the fuser roll. Such a condition allows the tip 110 to lift the sheet off the fuser roll, much in the manner of a spatula lifting food off of a frying-pan. In contrast, if the tip of a stripper finger engages the edge of a sheet at a point more than half the thickness of the sheet from the fuser roll surface, a lead edge nick is likely to occur, because the tip of the stripper finger will fold the sheet as opposed to smoothly lifting it. The design of the stripper finger of the present invention facilitates such a close engagement of the edge of the sheet, while retaining the strength and flexibility of a thicker stripper finger. In the common context of stripping bond paper from the fuser roll, the present invention has been found to avoid these lead edge nicks when the thickness at tip 110 is approximately 0.05 mm.

Figure 4A:
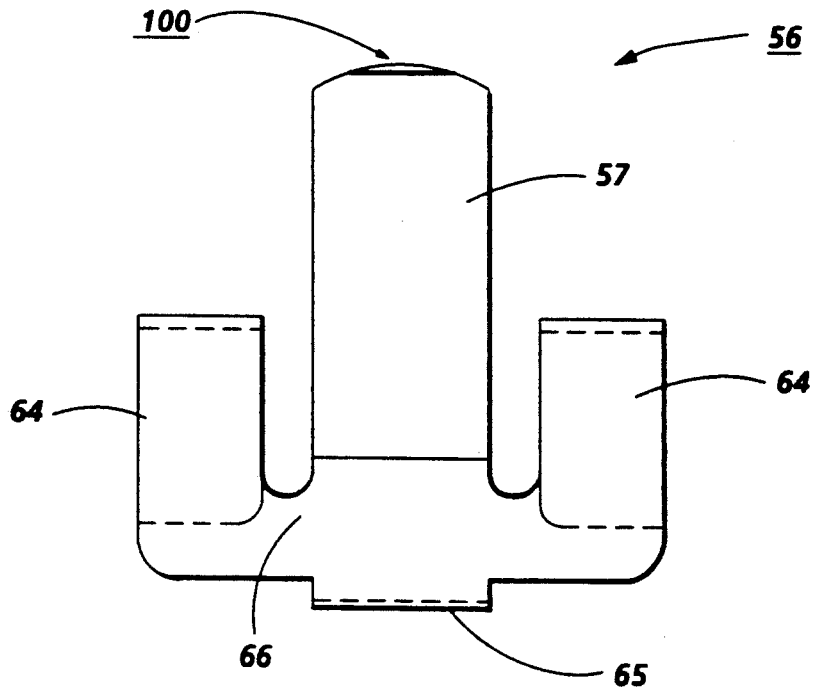
FIGS. 4A and 4B are alternate views of a stripper finger of the present invention, incorporated in a spring clip.
Figure 4B:
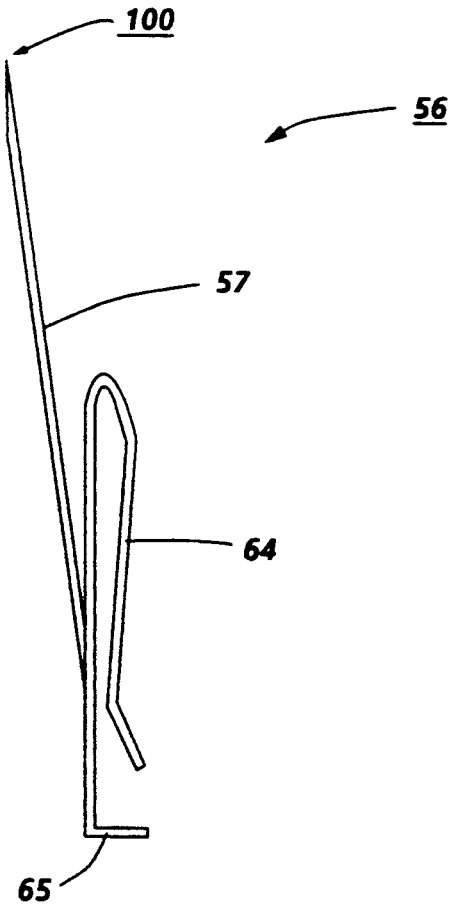

Stripper fingers of the claimed invention may be incorporated into any known arrangement for stripper fingers against a fuser roll. FIGS. 4A, 4B and 5A, 5B show one possible arrangement for the stripper fingers, but those skilled in the art will understand that many such variations in mounting the stripper fingers are possible. (Many of the parts shown in FIGS. 4A, 4B and 5A, 5B are also visible in FIG. 2.) FIGS. 4A and 4B are two views of a stripper finger 100 of the present invention, in the form of a one-piece spring clip generally indicated as 56. The spring clip 56 is provided with two holder elements 64, one on each side of the finger 100 and connected thereto by a stretcher element 66, all of which are preferably formed from a one-piece member by stamping of sheet metal stock. The holder elements 64 are formed by folding over two narrow finger-like members, one on each side of the stripper finger 100. The spring clip 56 may also have formed therein a tang 65 adapted to fit into a slot in a mounting member, as will be apparent below.

Figure 5A:
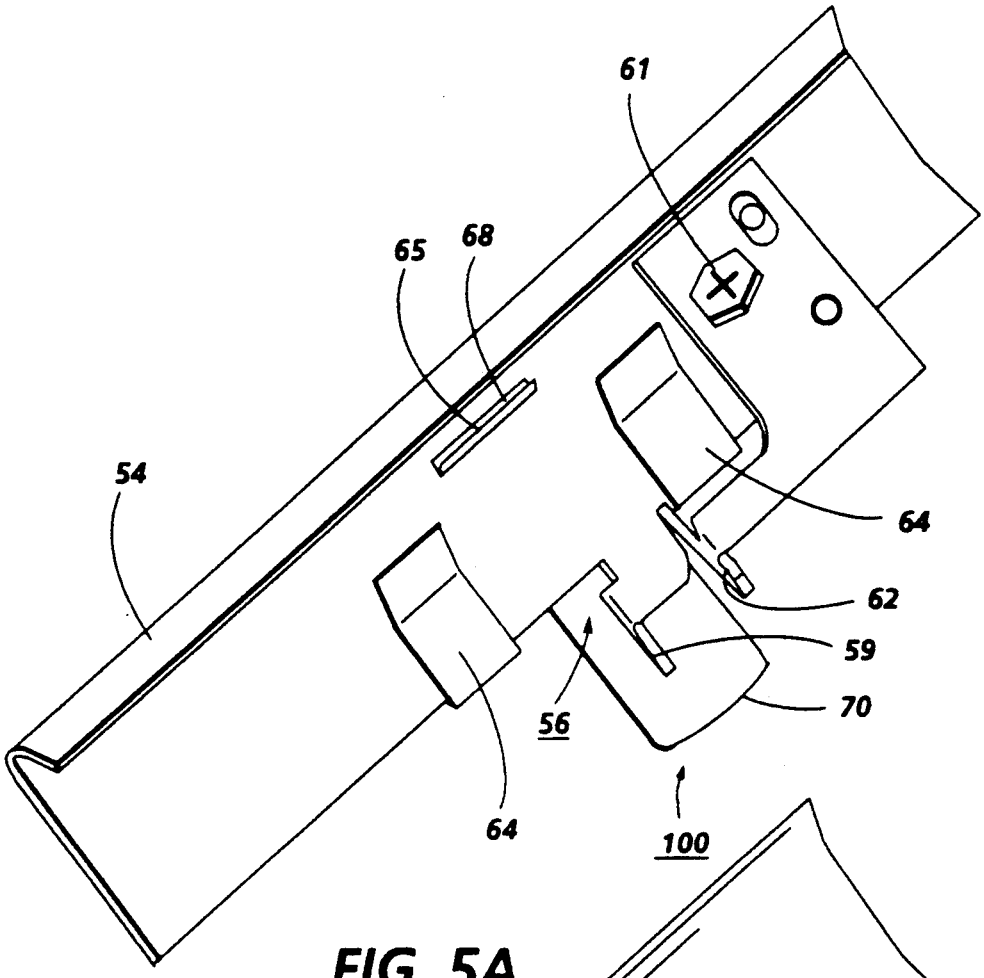
FIGS. 5A and 5B are alternate views of the spring clip incorporating the stripper finger of the present invention, mounted on a mounting baffle.
Figure 5B:
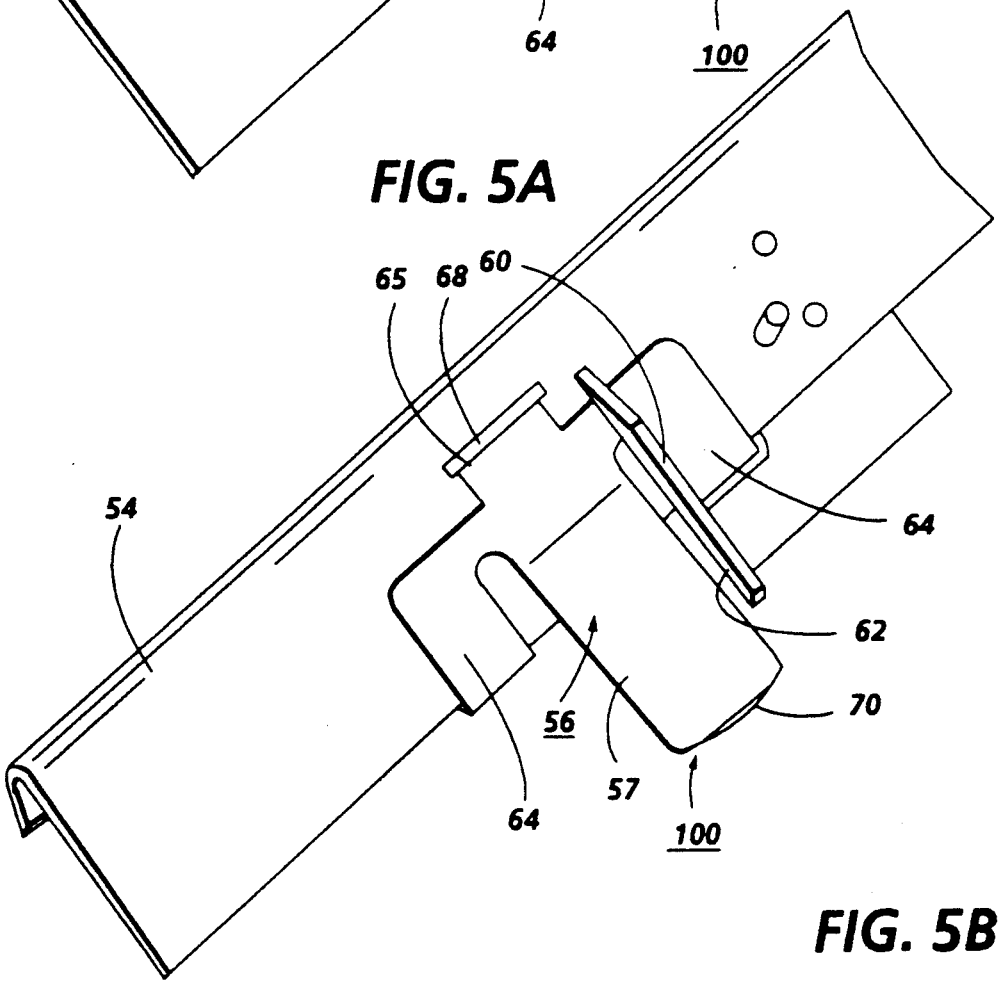

FIGS. 5A, 5B are alternate views of a mounting baffle generally indicated as 54, which is typical of a member upon which a stripper finger such as that described herein may be mounted within an electrophotographic printing apparatus. The mounting baffle 54, which is fixedly secured to frame members on each side of the printing machine (not shown), has a print substrate guide 62 having a deflector surface 60, affixed thereto by means of a screw 61. Each of the stripper fingers 100 on a single mounting baffle 54 is positioned adjacent to such a print substrate guide. In addition, a restrainer or backstop 59 is formed in the mounting baffle for each stripper member to provide a minimum angle of the stripper finger with respect to the tangent at the point of contact between the stripper finger and the fuser roll and to prevent excessive deflection of the fingerlike member 100 during hard stripping. The mounting baffle 54 may include a slot 68 for accepting the tang 65 formed in the spring clip 56. Preferably, a number of stripper fingers 100 will be mounted on a single mounting baffle 54, for ease in removing an individual sheet from a fuser roll. Typically, between eight and twelve such fingers 100 are mounted on a mounting baffle 54 disposed adjacent an 18-inch roll.

A common problem with stripper fingers of any design is accumulation of unfused toner material on the stripper fingers. In the present case, there will tend to be such an accumulation on surface 102 of the stripper finger 100. This accumulation of toner material may easily come into contact with a copy sheet coming off the fuser roll, and for this reason must be removed to prevent streaking of a copy sheet. In order to prevent this accumulation, at least one surface of the stripper finger may be coated with a low surface energy, highly wear resistant material. Typical such materials include fluorocarbon resins available under the trademark TEFLON made by E. I. duPont DeNemours and Company, Inc., typically of the varieties Teflon-P, PFA powder coating 532-5010, Teflon TE-9705, or TEFGEL fluoropolymer powder coating 532-6000. Another useful resin is that available under the trademark XYLAR 201B form Whitford Corporation. The above materials provide coatings having a surface energy of less than 25 dynes per centimeter. The low surface energy coating may be applied to the stripper finger 100 in any suitable manner.

The stripper finger 100 may be made from any suitable material. Spring steel is probably most suitable for stripping a paper substrate. Typical materials include 304 ¾hard stainless steel, or 301 full hard stainless steel. Use of full hard 302 stainless steel, without heat treatment, has been shown to provide satisfactory results.

The stripper finger 100 is preferably fabricated by coining a metal blank in a die, and then trimming the coined part to form the convex arc. Coining is simply the process of applying enough pressure to the metal stock to cause metal to flow perpendicular to the applied force. In the present case, the area of the stripper member 100 between the chord 112 and the tip 110 is pressed in a wedge-shaped die to yield a thin tip having the desired taper. The maximum thickness reduction depends on the starting hardness of the material and the cold workability of the stock. The edge of the coined stripper finger will crack if it is thinned out too much. Because of the bidirectional flow of the steel, it is possible to warp the finger if too large an area is coined. Metal flows away from an undeformed section as well as perpendicular to it, causing an undeformed part of one width to be intimately connected to a deformed section of a wider width; if too large an area is coined, these sections will tend to form a cup shape to reach minimum metal stress. The area of coining must be kept very small, so that the stiffness of the member is great enough to overcome these internal stresses and remain substantially flat. Larger areas could be coined, but this would require heat treatment to relieve residual stresses, and treatment of such thin parts require fixturing to hold them in the desired shape.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A stripper member for separating a substrate from a surface of a fuser member, comprising:

a first surface;

a second surface, opposed from the first surface and defining a thickness therebetween;

an edge, shaped in the form of a symmetrical convex arc across the width of the first surface and the second surface;

the thickness between the first surface and the second surface decreasing from a chord through the convex arc perpendicular to the axis of symmetry of the arc, to the edge.

2. A stripper member as in claim 1, made of metal.

3. A stripper member as in claim 1, made of spring steel.

4. A stripper member as in claim 1, further comprising a coating on at least a portion thereof, the coating having a low surface energy.

5. A stripper member as in claim 1, wherein the edge at the axis of symmetry of the arc has a thickness not more than one-half the thickness of the substrate to be separated from the fuser member.

6. A stripper member as in claim 1, wherein the first surface includes a planar portion and the second surface includes a tapered portion.

7. An electrophotographic printing apparatus, comprising:

a fuser roll;

a pressure roll, forming with the fuser roll a nip therebetween for the passage of a substrate therethrough; and a stripping assembly adjacent the fuser roll for stripping a substrate therefrom, the assembly including at least one stripper member, the stripper member including a first surface, disposed adjacent a surface of the fuser roll, a second surface, opposed from the first surface and defining a thickness therebetween, an edge, shaped in the form of a symmetrical convex arc across the width of the first surface and the second surface, the thickness between the first surface and the second surface decreasing from a chord through the convex arc perpendicular to the axis of symmetry of the arc, to the edge.

8. An electrophotographic printing apparatus as in claim 7, wherein the stripper member is made of metal.

9. An electrophotographic printing apparatus as in claim 7, wherein the stripper member is made of spring steel.

10. An electrophotographic printing apparatus as in claim 7, wherein the stripper member includes a coating on at least a portion thereof, the coating having a low surface energy.

11. An electrophotographic printing apparatus as in claim 7, wherein the edge at the axis of symmetry of the arc has a thickness not more than one-half the thickness of the substrate to be separated from the fuser member.

12. An electrophotographic printing apparatus as in claim 7, wherein the first surface of the stripper member includes a planar portion and the second surface includes a tapered portion.

13. An electrophotographic printing apparatus as in claim 7, wherein the first surface of the stripper member is disposed at not more than 20° and not less than 10° relative to the surface of the fuser roll at the edge at the axis of symmetry of the arc.

14. An electrophotographic printing apparatus as in claim 7, wherein a point on the edge of the stripper member through the axis of symmetry of the arc is disposed at approximately 3 millimeters downstream of the nip between the fuser roll and the pressure roll.

15. An electrophotographic printing apparatus as in claim 7, wherein the stripping assembly applies the stripper finger onto the surface of the fuser roll at a force of not more than 20 grams and not less than 10 grams.

* * * * *